US005678252A

United States Patent [19]

Ball

[11] Patent Number: 5,678,252

[45] Date of Patent: Oct. 21, 1997

[54] DUAL MANIFOLD FLUSHING ASSEMBLY

[76] Inventor: Daniel W. Ball, 2079 Antoine Dr., Houston, Tex. 77055

[21] Appl. No.: 544,144

[22] Filed: Oct. 17, 1995

[51] Int. Cl.[6] ..... E03D 1/14

[52] U.S. Cl. ..... 4/326

[58] Field of Search ..... 4/326, 327, 405, 4/412

[56] References Cited

U.S. PATENT DOCUMENTS

| | | | |
|---|---|---|---|
| 1,963,211 | 6/1934 | Patterson | 4/326 |
| 3,375,531 | 4/1968 | Lake | 4/326 |
| 3,795,016 | 3/1974 | Eastman | 4/326 |
| 4,011,604 | 3/1977 | Goldsworthy | 4/326 |
| 5,033,129 | 7/1991 | Gajewski | 4/326 |
| 5,261,129 | 11/1993 | Roy | 4/326 |
| 5,381,561 | 1/1995 | Carson, III | 4/326 |

*Primary Examiner*—Charles E. Phillips
*Attorney, Agent, or Firm*—Chamberlain, Hrdlicka, et al; Wendy K. Buskop; Cynthia G. Seal

[57] ABSTRACT

In one embodiment of the present invention, there is provided an environmentally conscious manifold system for a flush tank that conserves water. The system has a flush tank, a box, a first manifold flushing assembly, a second manifold flushing assembly, a flush arm and a compact ballcock assembly. The flush tank has a front wall, a bottom wall, an inside surface and an outside surface. The bottom surface has a conventional tank drain and a water valve disposed therein. The box has a top surface and a bottom surface and is positioned adjacent to the bottom wall on the inside surface of the flush tank. The top surface defines a first hole and a second hole, the bottom surface defines a third hole. The third hole is sealably connected to the flush tank drain. The first manifold flushing assembly has a first trip lever and is attached to the first hole. The second manifold flushing assembly has a second trip lever and is attached to the second hole. The first manifold has a first height and the second manifold has a second height, the first height being greater than the second height. The flush arm has first trip lever and the second trip lever attached thereto. The system needs a compact ballcock assembly, such as Fluidmaster, in order to fit the manifold assembly into the tank. The compact ballcock assembly is attached to the water valve in the flush tank and associated with the second flushing assembly in a conventional manner. Methods for disposing of solid and liquid waste while conserving water, using the current invention are also disclosed.

13 Claims, 3 Drawing Sheets

DUAL MANIFOLD FLUSHING ASSEMBLY

BACKGROUND OF THE INVENTION

This invention relates to a dual manifold system used with gravity flush, water closet type toilets having at least a 3.5 gallon capacity. A method for using a dual manifold system with this type of toilet that conserves water is also disclosed.

The average flush toilet is made of materials that last at least a lifetime. This invention is specifically designed for the older toilets that use 3.5 gallons of water per flush. Typical toilets are designed so that the chamber stays about half full of water. When the tank is flushed, the water is sucked out of the chamber evacuating the bowl of its contents. Conventional tanks consume from 3½ to 5 gallons of water per flush. It does not take 3½ gallons of water to adequately dispose of human liquid waste. The average person flushes the toilet 12 times a day, one of which is usually solids. This translates into 42 gallons of water per person per day. It takes 1.5 gallons of water to adequately dispose of liquid waste. If 11 of the 12 flushes only use 1.5 gallons, the 42 gallons gets reduced to 20 gallons per day. Flushing liquids with 1.5 gallons as opposed to 3.5 gallons, accounts for a 47 percent decrease in the amount of water used per person. A flush system that uses less water for liquid waste would be ecologically more efficient and environmentally sound.

New government regulations require that all newly manufactured toilets use only 1.6 gallons per flush. This does not apply to the older toilets that use 3.5 to 5 gallons of water per flush. A system that can be employed in existing toilets to use less water for disposing of liquid waste would be highly desirable. The regulations clearly indicate a need for conserving water.

OBJECTS OF THE INVENTION

It is an object of the present invention to provide a dual manifold system that uses less water per flush than the conventional toilets that use 3.5 gallons or more of water.

It is another object of the present invention to provide a method for disposing of human liquid waste using less water than a 3.5 gallon capacity toilet.

It is a further object of the present invention to provide a method for disposing of human solid waste with a system that is capable of flushing 1.5 or 3.5 gallons of water per flush.

SUMMARY OF THE INVENTION

In one embodiment of the present invention, there is provided an environmentally conscious retrofit manifold system for a flush tank, with at least a 3.5 gallon capacity, that conserves water. The system comprises a flush tank, a box, a first manifold flushing assembly, a second manifold flushing assembly, a flush arm and a compact ballcock assembly. The flush tank has a front wail, a bottom wail, an inside surface and an outside surface. The flush tank can be made of porcelain, composite, plastic, or metal materials. The bottom surface has a conventional tank drain and a water valve disposed therein. The box has a top surface and a bottom surface and is positioned adjacent to the bottom wall on the inside surface of the flush tank. The top surface defines a first hole and a second hole, the bottom surface defines a third hole. The third hole is sealably connected to the flush tank drain. The first manifold flushing assembly has a first trip lever and is attached to the first hole. The second manifold flushing assembly has a second trip lever and is attached to the second hole. The first manifold has a first height and the second manifold has a second height, the first height being greater than the second height. The first trip lever has a means for engaging the second trip lever, preferably a pin. The flush arm has the first trip lever and the second trip lever attached thereto. The system needs a compact ballcock assembly, such as Fluidmaster, in order to fit the manifold assembly into the tank. The compact ballcock assembly is attached to the water valve in the flush tank and associated with the second flushing assembly in a conventional manner.

In another embodiment, there is provided a method for disposing of liquid human waste in a flush tank with at least a 3.5 gallon capacity, using a dual manifold flush system that conserves water. The method comprises providing a flush tank as described above. The flush arm is rotated to open the first flushing assembly. This releases the minimum mount of water needed to adequately flush the liquid waste, preferably about 1.5 gallons.

In yet another embodiment, there is provided a method for disposing of solid human waste in a flush tank, with at least a 3.5 gallon capacity, using a dual manifold flush system that conserves water. The method comprises providing a flush tank as described above. The flush arm is moved to a second position and rotated to open the first flushing assembly and the second flushing assembly. This releases the minimum amount of water needed to adequately flush the solid waste, preferably about 3.5 gallons.

DETAILED DESCRIPTION OF THE PREFERRED EMBODIMENTS

Figure 1:
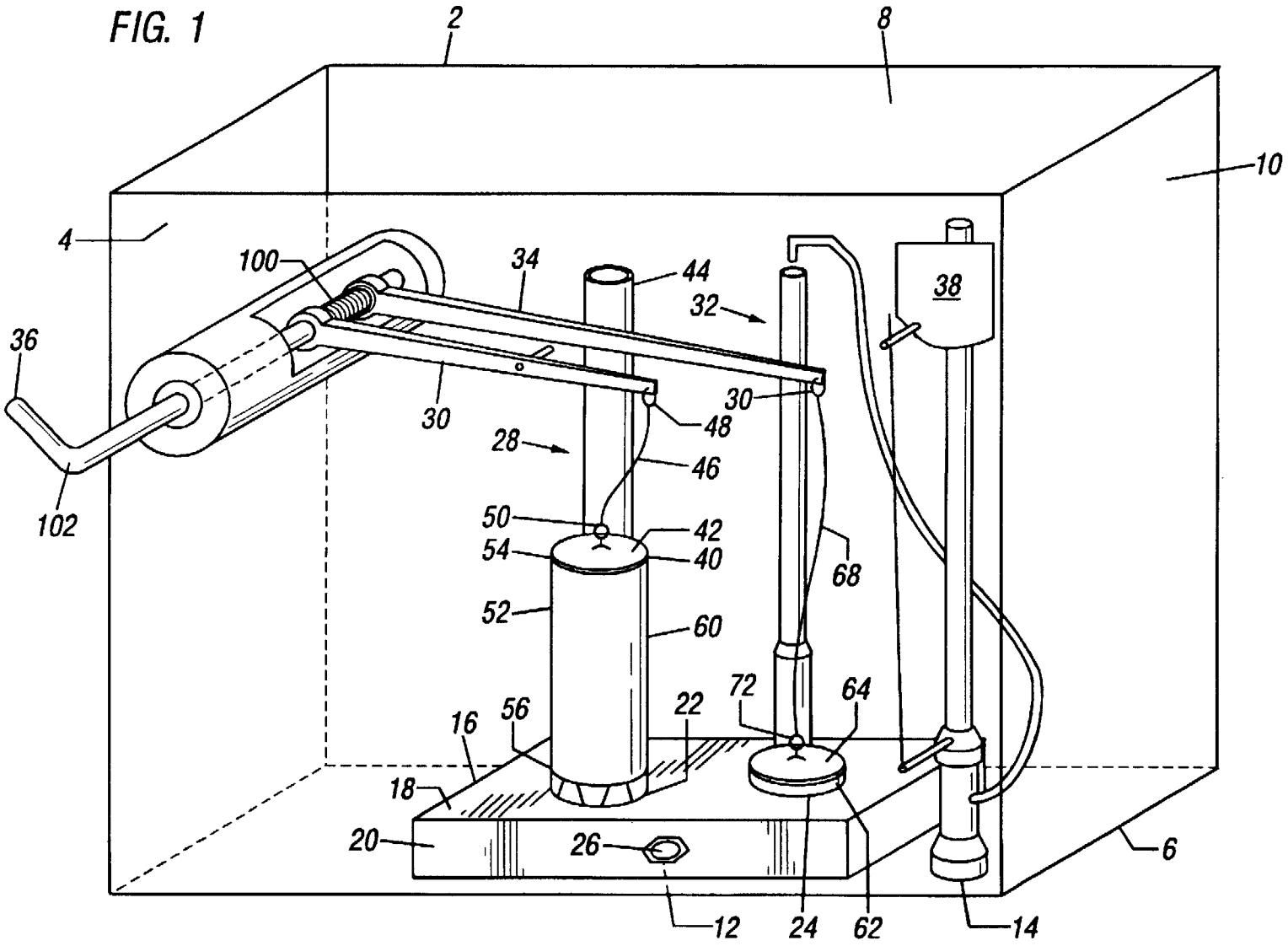
FIG. 1 is a plan view of the system in the flush tank.
Figure 2:
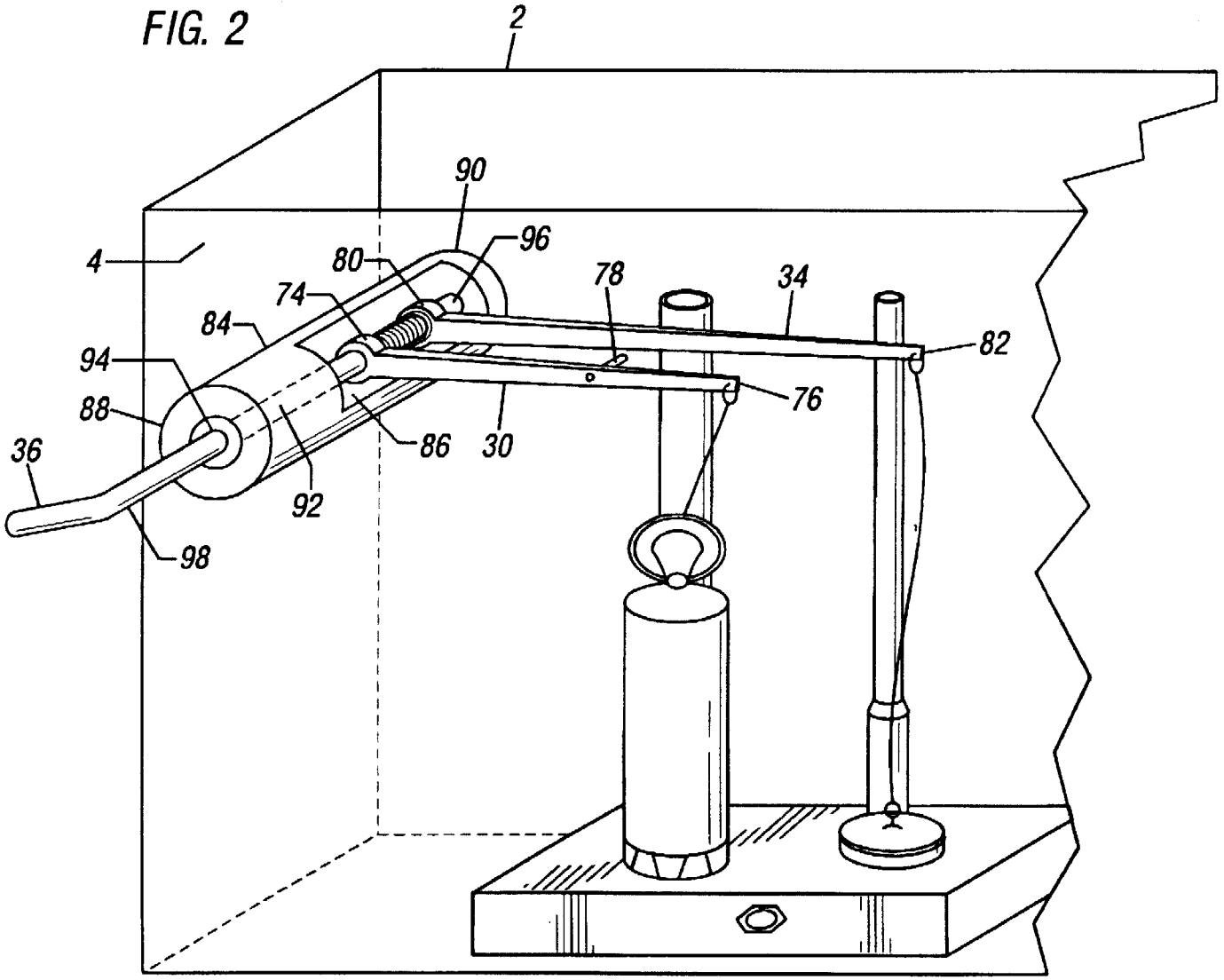
FIG. 2 is a plan view of the system when the spring is in a first position.
Figure 3:
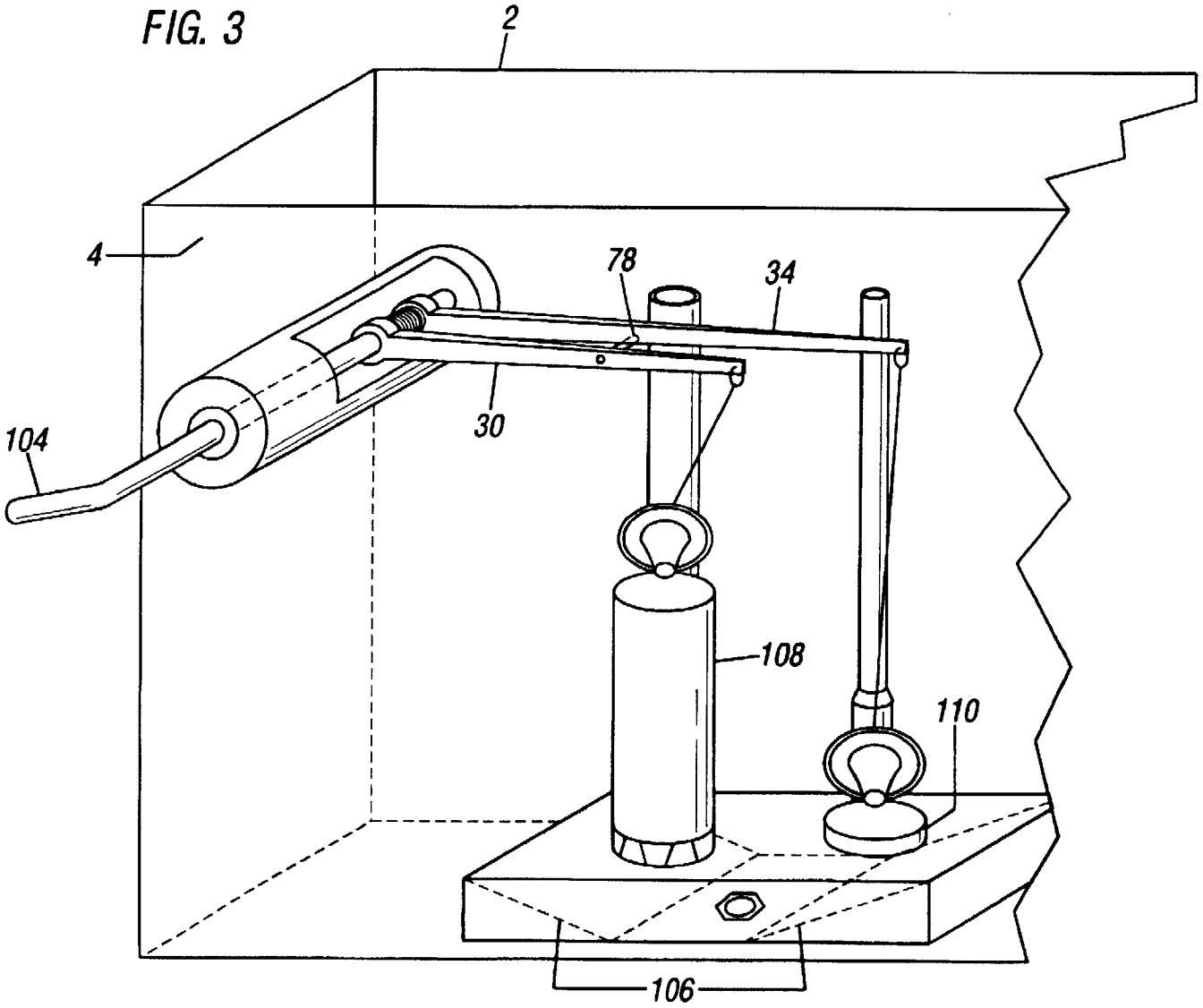
FIG. 3 is a plan view of the system when the spring is in a second position.

In one embodiment of the present invention, there is provided an environmentally conscious retrofit manifold system for a flush tank 2, with at least a 3.5 gallon capacity, that conserves water. The system comprises a flush tank 2, a box 16, a first manifold flushing assembly 28, a second manifold flushing assembly 30, a flush arm 36 and a compact ballcock assembly 38. The flush tank 2 has a front wall 4, a bottom wail 6, an inside surface 8 and an outside surface 10. The inside surface 8 of the bottom wail 6 has a conventional tank drain 12 and a water valve 14 disposed therein. The box 16 has a top surface 18 and a bottom surface and is positioned adjacent to the bottom wail 6 on the inside surface of the flush tank 2. The top surface 18 defines a first hole 22 and a second hole 24, the bottom surface 20 defines a third hole 26. The third hole 26 is sealably connected to the flush tank 2 drain preferably using a spud nut. The box 16 is preferably generally rectangular in shape and has baffles 106 to direct a flow of water from the first and second holes towards the third hole 26. The box can be made of any suitable rigid material that is water resistant such as plexiglass, fiberglass, metal, or plastic.

The first manifold flushing assembly 28 has a first trip lever 30 and is attached to the first hole 22. In a preferred embodiment, the first manifold flushing assembly 28 comprises a first valve seat 40, a first flapper 42, an air vent assembly 44, a first lift chain 46, and a generally cylindrical tube 52. The first flapper 42 may be in covering relationship to the first valve seat 40. The air vent assembly 44 can be associated with the flushing assembly in a conventional manner. The first lift chain 46 preferably has a first end 48 and a second end 50, where the first end is attached to the first flapper 42 and the second end 50 is attached to the first trip lever 30. The generally cylindrical tube 52 has a first end 54, a second end 56, an inner surface 58 and an outer surface 60. The first end 54 of the tube 52 preferably closely receives the first valve seat 40. The second end 56 of the tube has threads on the outer surface 60 that are threadably received by the first hole 22 and preferably held in place by a spud nut. The tube 52 can be made of PVC (polyvinyl chloride) or any other suitable water resistant material.

The second manifold flushing assembly 30 has a second trip lever 34 and is attached to the second hole 24. Preferably, the second manifold flushing assembly 30 comprises a second valve seat 62, a second flapper 64, an air vent assembly 66, and a second lift chain 68. The second flapper 64 is in covering relationship to the second valve seat 62. The air vent assembly 66 is associated with the flushing assembly in a conventional manner. The second lift chain 68 has a first end 70 and a second end 72 where the first end 70 is attached to the second flapper 64 and the second end 72 is attached to the second trip lever 34. The second valve seat 62 is closely received by the second hole 24. The first trip lever 30 has a means for engaging the second trip lever 34, preferably a pin 78.

The first manifold has a first height 108 and the second manifold has a second height 110, the first height 108 being greater than the second height 110. Preferably, the height of the first manifold is approximately one half the tank height. The flush arm 36 has the first trip lever 30 and the second trip lever 34 attached thereto. Preferably, there is provided a generally tubular housing 84 having a window cut out 86 with the flush arm 36 positioned within the window of the housing in a coaxial relationship with the housing. The tubular housing 84 preferably has a first end 88 and a second end 90. The window cut out 86 preferably extends longitudinally from the first end 88 to the second end 90, and circumferentially about approximately one third of the circumference of the housing 84. The first trip lever 30 may have a first end 74, a second end 76, with the pin 78 attached therebetween. The second end of the first trip lever 30 is preferably attached to the second end of the first lift chain 46. The pin 78 is preferably positioned normal to a longitudinal axis of the first trip lever 30 and extends towards the second trip lever 34. Preferably, the second trip lever 34 further comprises a first end and a second end. The second end is preferably attached to the second end of the second lift chain 68. The second trip lever 34 is contained in a plane substantially parallel to a plane containing the first trip lever 30. The system requires a compact ballcock assembly 38, such as Fluid master, in order to fit the manifold assembly into the tank. The compact ballcock assembly 38 is attached to the water valve 14 in the flush tank 2 and associated with the second flushing assembly in a conventional manner.

In a preferred embodiment, the flush arm 36 is generally L-shaped and has a straight portion 92 with a first end 94 and a second end 96, and a bent portion 98 attached to the first end 94. The second end 96 is rotatably slip mounted to the second end 90 of the housing 84. The first end 80 of the second trip lever 34 is slidably and rotatably mounted near the second end 96 of the straight portion 92. The first end 74 of the first trip lever 30 is fixedly attached to the straight portion 92 between the first end 94 of the straight portion 92 and the second trip lever 34. The flush arm 36 preferably has a spring 100 positioned on the straight portion 92 of the flush arm 36 between the first trip lever 30 and the second trip lever 34. The spring 100 forms a first flush arm position 102 when relaxed and a second flush arm position 104 when compressed. The flush arm 36 extends through the front wall 4 of the tank so that the straight portion 92 is contained within the tank and is positioned generally normal to the from wall 4. The bent portion 98 is positioned outside the tank and generally parallel to the front wall 4.

In use, the first flapper 42 is disengaged from the first valve seat 40 when the flush arm 36 is rotated in the first flush arm position 102. Preferably, when the flush arm 36 is in the first flush arm position 102, approximately 1.5 gallons of water are released from the flush tank 2. The pin 78 extending from the first trip lever 30 engages the second trip lever 34 when the flush arm 36 in the second flush arm position 104. The first and second flappers are then disengaged from the first and second valve seats when the flush arm 36 is rotated in the second flush arm position 104. Preferably, when the flush arm 36 is in the second flush arm position 104, approximately 3.5 gallons of water are released from the flush tank 2. As an option, flapper 42 can be positioned at the same height as flapper 64 with flapper 42 having a manifold assembly with a float disposed at the midpoint of the tank, the float being at the same height as the tube 60.

In another embodiment, there is provided a method for disposing of liquid human waste in a flush tank 2, with at least a 3.5 gallon capacity, using a dual manifold flush system that conserves water. The method comprises providing a flush tank 2 as described above and rotating the flush arm 36 to open the first flushing assembly. This releases the minimum amount of water needed to adequately flush the liquid waste. Therefore the tank only uses approximately 1.5 gallons of water to dispose of liquid waste, saving approximately 2 gallons every time the toilet is flushed using this dual manifold system.

In yet another embodiment, there is provided a method for disposing of solid human waste in a flush tank 2, with at least a 3.5 gallon capacity, using a dual manifold flush system that conserves water.

The method comprises providing a flush tank 2 as described above. The flush arm 36 is moved to a second position 104 where the first trip lever 30 engages the second trip lever 34 and rotated to open the first flushing assembly and the second flushing assembly. This releases the minimum amount of water needed to adequately flush the solid waste. This allows one to use an existing 3.5 gallon flush tank as a 1.5 or a 3.5 gallon tank without having to replace the tank. Optionally this system may be used with new flush tanks.

EXAMPLE

The dual manifold system described above can be used with any tank that has a greater than 1.5 gallon capacity. This system is designed to conserve water in tanks that use more than 1.5 gallons of water per flush, while adequately disposing of liquid and solid waste. The system can be installed in an existing tank that uses a Fluidmaster or other type of compact ballcock assembly. In use, to dispose of liquid waste, the flush arm is simply rotated, this rotation causes the first trip lever to be raised and the first flapper to be disengaged from the valve seat. The first flapper and first valve seat are positioned on top of a cylindrical tube that is approximately half of the tank height. This positioning allows only a limited amount of water to be relesed when the first trip lever is raised, therefore conserving water when liquid waste is being disposed.

When disposing of solid waste, the flush arm is pushed in toward the front wall of the tank and then rotated. In this compressed position, the first trip lever engages the second trip lever so that when the flush arm is rotated both the first and the second trip levers are raised simultaneously. This allows for virtually all of the water in the tank to be released. For convenience, a spring is positioned between the first trip lever and the second trip lever so that the first trip lever will easily disengage the second trip lever when the toilet has been flushed and the flush arm released. This type of dual manifold system allows for users to keep their old tanks and conserve water as mandated by the new government regulations limiting tank volumes to 1.5 gallons.

Optionally, the dual manifold system may be utilized without the cylindrical tube and a float system for drainage. Further as an option, the system can be a retrofit system.

What is claimed is:

1. A manifold system for a flush tank, said system comprising:

a flush tank having a front wall, a bottom wall, an inside surface and an outside surface, said bottom surface having a tank drain and a water valve disposed therein;

a box having a top surface and a bottom surface, said top surface defining a first hole and a second hole, said bottom surface defining a third hole, said box being positioned adjacent to the bottom wall on the inside surface of the tank, wherein said third hole is sealably connected to the flush tank drain;

a first manifold flushing assembly having a first trip lever, the first flushing assembly being attached to said first hole;

a second manifold flushing assembly having a second trip lever, the second flushing assembly being attached to said second hole, wherein the first manifold has a first height and the second manifold has a second height, said first height being greater than said second height;

a flush arm, with the first trip lever and the second trip lever being attached thereto, said first trip lever having a means for engaging said second trip lever; and a compact ballcock assembly attached to the water valve in the flush tank, said compact ballcock assembly being associated with the second flushing assembly, wherein the first manifold flushing assembly further comprises:

a first valve seat, a first flapper in covering relationship to said first valve seat, an air vent assembly associated therewith a first lift chain having a first end and a second end, said first end being attached to the first flapper, said second end being attached to the first trip lever, and a generally cylindrical robe having a first end, a second end, an inner surface and an outer surface, wherein said first end of the tube closely receives said valve seat, said second end of the tube having threads on the outer surface, wherein said second end of the tube is threadably received by the first hole; and the second manifold flushing assembly further comprises:

a second valve seat; a second flapper in covering relationship to said second valve seat; an air vent assembly associated therewith; and a second lift chain having a first end and a second end, said first end being attached to the second flapper, said second end being attached to the second trip lever; wherein said second valve seat is closely received by the second hole;

wherein said first trip lever further comprises a first end, a second end and said means for engaging comprises a pin attached between the first end and the second end, wherein said second end is attached to the second end of the first lift chain, said pin being positioned normal to a longitudinal axis of the first trip lever, said pin extending towards the second trip lever;

wherein said second trip lever further comprises a first end and a second end, wherein said second end being attached to the second end of the second lift chain, said second trip lever contained in a plane substantially parallel to a plane containing said first trip lever;

further comprising a generally tubular housing having a window cut out, said flush arm being positioned within the window of the housing in a coaxial relationship with the housing.

2. The system of claim 1, wherein said generally tubular housing further comprises a first end and a second end, wherein said window cut out extends longitudinally from the first end to the second end, and circumferentially about approximately one third of the circumference of the housing.

3. The system of claim 2, wherein said flush arm is generally L-shaped and further comprises a straight portion having a first end and a second end, and a bent portion attache to the first end, wherein said second end is rotatably slip mounted to the second end of the housing, the first end of the second trip lever is slidably and rotatably mounted near the second end of the straight portion, and the first end of the first trip lever is fixedly attached to the straight portion between the first end of the straight portion and the second trip lever.

4. The system of claim 3, wherein the flush arm extends through the front wall of the tank so that the straight portion is contained within the tank and is positioned generally normal to the front wall and the bent portion is positioned outside the tank and generally parallel to the front wall.

5. The system of claim 4, further comprising a spring positioned on the straight portion of the flush arm between the first trip lever and the second trip lever, said spring forming a first flush arm position when relaxed and a second flush arm position when compressed.

6. The system of claim 5, wherein the first flapper is disengaged from the first valve seat when the flush arm is rotated in the first, flush arm position, and the extending from the first trip lever engages the second trip lever when the flush arm in the second flush arm position so that the first and second flappers are disengaged from the first and second valve seats when the flush arm is rotated in the second flush arm position.

7. The system of claim 6, wherein when the flush arm is in the first flush arm position, approximately 1.5 gallons of water are released, and when the flush arm is in the second flush arm position, approximately 3.5 gallons of water are released.

8. The system of claim 7, wherein the box is generally rectangular in shape.

9. The system of claim 8, wherein the height of the first manifold is approximately one half the tank height.

10. A method for disposing of liquid human waste in a flush tank with a dual manifold flush system wherein the flush tank has the following characteristics a front wall, a bottom wall, an inside surface and an outside surface, said bottom surface having a tank drain and a water valve disposed therein, said flush tank having at least a 3.5 gallon capacity, said flush tank further comprising;

a box having a top surface and a bottom surface, said top surface defining a first hole and a second hole, said bottom surface defining a third hole, said box being positioned adjacent to the bottom wall on the inside surface of the tank, wherein said third hole is sealably connected to the flush tank drain, a first manifold flushing assembly having a first trip lever, the first flushing assembly being attached to said first hole, a second manifold flushing assembly having a second trip lever, the second flushing assembly being attached to said second hole, wherein the first manifold has a first height and the second manifold has a second height, said first height being greater than said second height, a flush arm, with the first trip lever and the second trip lever being attached thereto, a spring positioned on the flush arm between the first trip lever and the second trip lever, said spring forming a first flush arm position when relaxed and a second flush arm position when compressed, and a compact ballcock assembly attached to the water valve in the flush tank, said compact ballcock assembly being associated with the second flushing assembly;

said method comprising:

rotating said flush arm to open the first flushing assembly.

11. A method as in claim 10, wherein when the first flushing assembly is open, approximately 1.5 gallons of water are released from the flush tank.

12. A method for disposing of solid human waste in a flush tank with a dual manifold flush system wherein the flush tank has the following characteristics a front wall, a bottom wall, an inside surface and an outside surface, said bottom surface having a tank drain and a water valve disposed therein, said flush tank having at least a 3.5 gallon capacity, said flush tank further comprising:

a box having a top surface and a bottom surface, said top surface defining a first hole and a second hole, said bottom surface defining a third hole, said box being positioned adjacent to the bottom wall on the inside surface of the tank, wherein said third hole is sealably connected to the flush tank drain, a first manifold flushing assembly having a first trip lever, the first flushing assembly being attached to said first hole, a second manifold flushing assembly having a second trip lever, the second flushing assembly being attached to said second hole, wherein the first manifold has a first height and the second manifold has a second height, said first height being greater than said second height, a flush arm, with the first trip lever and the second trip lever being attached thereto, a spring positioned on the flush arm between the first trip lever and the second trip lever, said spring forming a first flush arm position when relaxed and a second flush arm position when compressed, and a compact ballcock assembly attached to the water valve in the flush tank, said compact ballcock assembly being associated with the second flushing assembly; and said method comprising:

rotating said flush arm to open said first flushing assembly and said second flushing assembly.

13. A method as in claim 12, wherein when the flush arm is rotated to open said first flushing assembly and said second flushing assembly, approximately 3.5 gallons of water are released from the flush tank.

* * * * *